US005722447A

United States Patent [19]

Morgan et al.

[11] Patent Number: 5,722,447

[45] Date of Patent: Mar. 3, 1998

[54] CONTINUOUS RECIRCULATION FLUID DELIVERY SYSTEM AND METHOD

[75] Inventors: Vernon E. Morgan, Dallas; Carl D. Reedy, Plano, both of Tex.

[73] Assignee: Texas Instruments Incorporated, Dallas, Tex.

[21] Appl. No.: 235,725

[22] Filed: Apr. 29, 1994

[51] Int. Cl.[6] ..... B67D 5/00

[52] U.S. Cl. ..... 137/1; 137/256; 137/263

[58] Field of Search ..... 137/255, 256, 137/263, 265, 1

[56] References Cited

U.S. PATENT DOCUMENTS

| | | | |
|---|---|---|---|
| 2,192,727 | 3/1940 | Courtis et al. | 137/263 X |
| 2,372,448 | 3/1945 | Porteous | 137/256 X |
| 4,393,013 | 7/1983 | McMenamin . | |
| 4,436,674 | 3/1984 | McMenamin . | |
| 4,446,804 | 5/1984 | Kristiansen et al. | 137/256 X |
| 5,014,737 | 5/1991 | Berman . | |
| 5,054,519 | 10/1991 | Berman . | |
| 5,148,945 | 9/1992 | Geatz . | |
| 5,224,841 | 7/1993 | Thompson et al. . | |
| 5,237,878 | 8/1993 | Hackenberg . | |
| 5,242,468 | 9/1993 | Clark et al. . | |

OTHER PUBLICATIONS

David J. Powell, "Sematech Non Confidential–Applied Chemical Solutions VP2001 Pumpless Chemical Distribution System," Sep. 2, 1993, Technology Transfer 93071749A–TR, *Sematech, Inc.*

"Applied Chemical Solutions–VP 2001 Vacuum/Pressure Chemical Distribution System" brochure.

*Primary Examiner*—Kevin Lee

*Attorney, Agent, or Firm*—Stanton C. Braden; Wade James Brady, III; Richard L. Donaldson

[57] ABSTRACT

A fluid delivery system (10, 210) is disclosed that includes a pipeline network (20, 220) having a chemical supply line (12, 14, 212), a filtering system (134, 235), a feeding portion (24, 224), and a return portion (26, 226). A first tank (28, 228), a second tank (30, 230), and a third tank (32, 232) are coupled to the feeding portion (24, 224) and the return portion (26, 226) of the pipe network (20, 220). A control module (100) is coupled to a multiplicity of valves (46, 52, 48, 54, 50, 56, 70, 86, 72, 88, 74, 90) for controlling the flow of the fluid through the system in a manner that provides a continuous and bumpless flow of the fluid. Additionally, the system (10, 210) may include a plurality of sensors (94, 96, 98) that allow control module 100 to sense the volume of fluid in the system (10, 210) and each tank (28, 30, 32, 228, 230, 232). Fluid flow through the pipe network (20, 220) is promoted by a pressure differential between a pressure source (58, 264, 266, 268) and a vent line or second pressure source (78, 278). A method of circulating the fluid with system (10, 210) is also provided.

20 Claims, 4 Drawing Sheets

CONTINUOUS RECIRCULATION FLUID DELIVERY SYSTEM AND METHOD

TECHNICAL FIELD OF THE INVENTION

This invention relates to fluid delivery systems, and more particularly, relates to a continuous recirculation systems.

BACKGROUND OF THE INVENTION

In many manufacturing processes, such as semiconductor wafer processing, it is necessary to deliver very pure fluids with the desired chemical concentration and/or mixture.

Extremely pure chemicals are necessary to prevent possible contamination of the product by particles. For example, in semiconductor processing, chemicals are delivered at almost every step of the processing and a single particle of 1/10 of a micron can cause a short-type defect in the integrated circuit being developed. Therefore, in transferring high purity chemicals by pipeline to a wafer fabrication unit, it is desirable to reduce and maintain particles at the lowest possible level.

SUMMARY OF THE INVENTION

The present invention provides a chemical or fluid delivery system that eliminates or greatly reduces the shortcomings of prior art systems. The chemical delivery system of the present invention may include three tanks interconnected by a pipeline and having a plurality of valves, a control module, and pressure source that are used to cause fluid to flow continuously and without transient high pressure surges that may allow for recirculation of the fluid at all times. According to another aspect of the present invention, soft closing and opening valves are provided in a fluid delivery system to facilitate the formation of a bumpless system.

A technical advantage of the present invention is that it provides a bumpless fluid delivery system that may help to prevent particulates captured by filters or adhering to the interior surface of pipes from breaking loose and possibly causing a defect or particle deposit on the wafer being processed. An additional advantage is that the system recirculates the chemical which may reduce the number of particulates in the chemical since the fluid passes more times through the filter or filters in the system.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION OF THE INVENTION

The preferred embodiments of the present invention and its advantages are best understood by referring to FIGS. 1–7 of the drawings, like numerals being used for like and corresponding parts of the various drawings.

Figure 1:
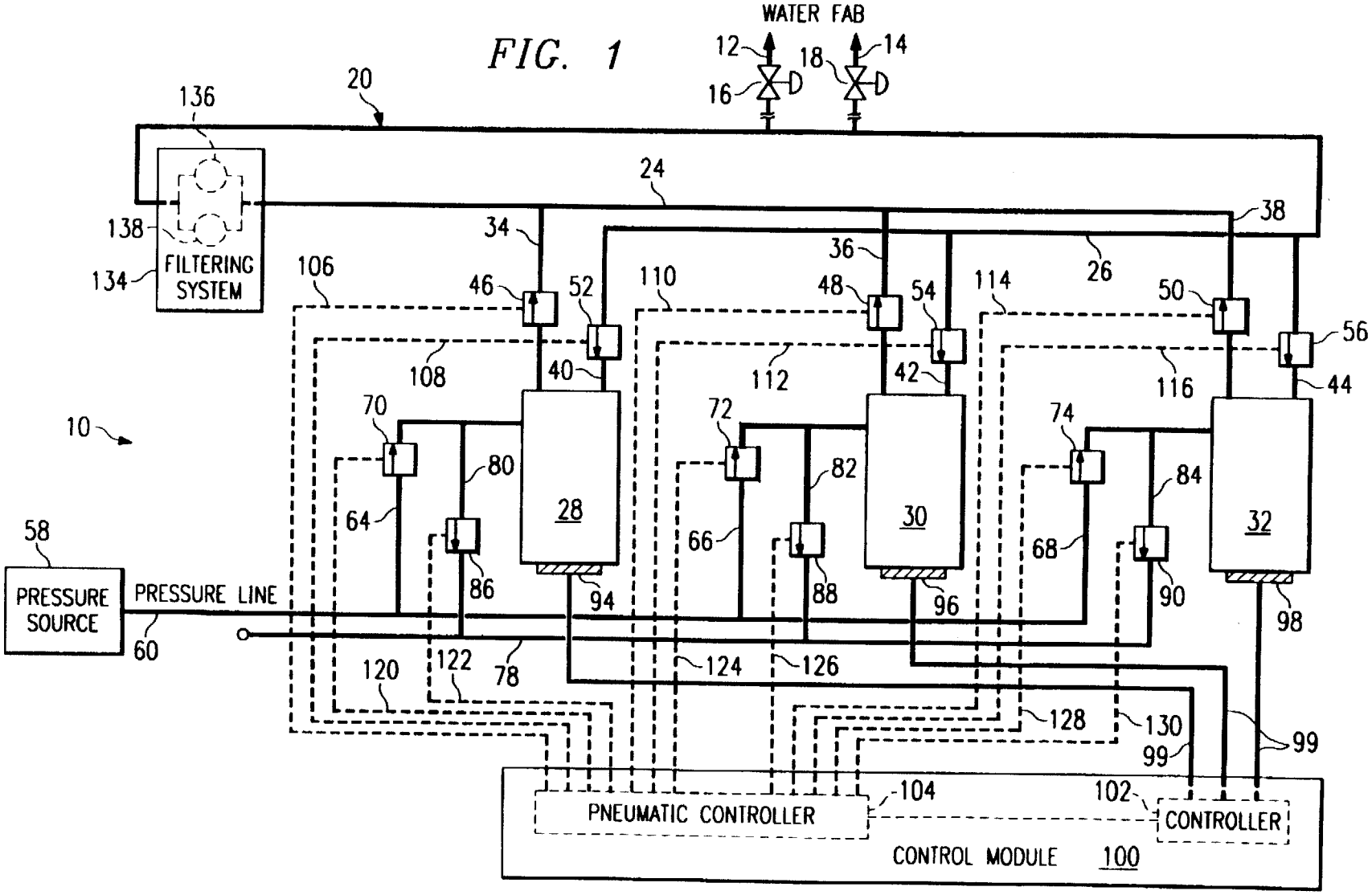
FIG. 1 is a schematic representation of one embodiment of the present invention.

Referring to FIG. 1, an embodiment of a continuous recirculation fluid delivery system 10 is shown. System 10 provides a fluid delivery system that allows for a continuous and bumpless flow. The term "bumpless" means that the fluid flows without transient high-pressure surges or pressure spikes.

System 10 may be used for each chemical or fluid that may be delivered during processing such as during semiconductor wafer fabrication processing. The user of the chemical, whether manual or automated, can access the chemical through fluid or chemical supply lines 12 and 14 which are controlled by valves 16 and 18 respectively. Fluid supply lines 12 and 14 and valves 16 and 18, like the pipes and valves to be discussed below, may be formed from any suitable material known in the art such as a TEFLON® material. Supply lines 12 and 14 communicate the desired fluid with pipeline network 20 which is formed from a plurality of pipes and connections. Pipeline network 20 has a feed portion 24 and a return portion 26.

The fluid flow through pipeline network 20 is designed to flow in response to the pressure differential generated by pressure source 58 to provide the necessary quantity of chemical to supply lines 12 and 14 for the predicted demand, but minimizing the possibility for turbulent flow.

System 10 may include three tanks or vessels for holding the desired chemical fluid or mixture of chemicals to be delivered by system 10: a first tank 28, which may be a stationary tank; a second tank 30, which may be a stationary tank; and a third tank 32, which may be a mobile tank. Tanks 28, 30, or 32 are sized as appropriate for the amount of fluid to be supplied; for example, tanks 28, 30, and 32 may be 200 gallon tanks in order to handle a wide variety of demand levels. Tanks 28, 30 and 32 may be connected to feed portion 24 of pipeline network 20 by pipes 34, 36 and 38 respectively. Similarly, tanks 28, 30 and 32 may be fluidly connected to return portion 26 of pipeline network 20 by pipes 40, 42, and 44 respectively.

A first plurality of valves may be connected to pipes 34, 36, 38 to control fluid flow from tanks 28, 30 and 32 into feed portion 24 of pipeline network 20; the first plurality of valves may include valve 46 on pipe 34, valve 48 on pipe 36, and valve 50 on pipe 38. Valves 46 to 50 may be selectively controlled by control module 100 as described in more detail below. Fluid flow from pipeline network 20 through return portion 26 and into tank 28, tank 30, and tank 32 may be controlled by a second plurality of valves including valve 52 on pipe 40, valve 54 on pipe 42, and valve 56 on pipe 44. The second plurality of control valves 52, 54, 56 may be selectively operated by control module 100 as described below.

The preferred embodiment of system 10 includes a pressure source 58 which charges the system in a manner that will cause fluid flow. The flow is in a clockwise direction through pipeline network 20 for the orientation shown. Pressure source 58 may be a pressurized nitrogen ($N_2$) supply. In an alternative embodiment, a pump such as a pneumatic bellows pump could be used in line 24 upstream of filtering system 134 to circulate the fluid through system 20, but a pressurized inert gas system is preferred. Pressure source 58 is coupled to a pressure line 60 having a plurality of pressure line segments 64, 66, and 68 that couple to a portion of tank 28, 30, and 32 respectively. Whether pressure source 58 is allowed to charge or pressure tank 28, tank 30, and tank 32 is controlled by a third plurality of valves, which may include valve 70 on pressure line segment 64, valve 72 on pressure line segment 66, and valve 74 on pressure line 68. The third plurality of valves may be selectively controlled by control module 100 as will be described below.

On occasion it is desirable to allow fluid from return portion 26 of pipeline network 20 to enter tanks 28, 30, and tank 32; for this purpose, tanks 28, 30 and 32 include a means for venting the tanks. Vent line 78 is provided which may vent to ambient or atmospheric pressure, or in an alternative embodiment, may be coupled to a vacuum source. Vent line 78 may have vent line portion 80 which couples vent line 78 with tank 28; vent line portion 82, which couples tank 30 with vent line 78; and vent line portion 84, which couples vent line 78 with third tank 32. The venting of each tank 28, 30, or 32 is controlled by a fourth plurality of valves that include valve 86 on vent line portion 80, valve 88 on vent line portion 82, and valve 90 on vent line portion 84. The fourth plurality of valves may be selectively controlled by control module 100 as will be described below.

In handling or processing the fluid or chemical in system 10, it may be necessary to take into account the amount of fluid in the system at any given time. For this purpose, a plurality of sensors or transducers may be incorporated into system 10. First tank 28 may have sensor 94 coupled to it. Second tank 30 may have sensor 96 coupled to it, and third tank 32 may have sensor 98 coupled to it. Sensors 94, 96, 98 may be, for example, pressure or force transducers, which allows control module 100 to calculate the volume of fluid in any one tank or in system 10 as a whole based on the density of the chemical. A float-type transducer or other fill transducer could also be used directly in each tank 28, 30, 32 to track the volume.

System 10 may be substantially automated to operate without human input once initiated. Control module 100 may allow for the automation of system 10 by controlling the first plurality 46, 48, and 50; second plurality 52, 54, and 56; third plurality 70, 72, and 74; and fourth plurality 86, 88, and 90 of valves in a predetermined sequence. Control module 100 is coupled to sensors 94, 96, and 98 by cables 99 such that control module 100 is aware of the total weight of the fluid in tanks 28, 30, and 32 (and therefore the volume since the density is known) at any given instance as well as the weight or volume of any specific tank. Control module 100 in the preferred embodiment includes a computer or processor or controller 102 and a pneumatic controller 104. Pneumatic controller 104 is coupled to computer 102. Control module 100 controls the plurality of valves to minimize hydraulic shock (bumps) and to allow system 10 to provide continuous recirculation.

A plurality of pneumatic lines couple the first plurality of valves 46, 48, and 50 and the second plurality of valves 52, 54, and 56 to control module 100 to allow each valve to be selectively controlled by control module 100. The plurality of pneumatic lines include pneumatic line 106 coupled to valve 46, pneumatic line 108 coupled to valve 52, pneumatic line 110 coupled to valve 48, pneumatic line 112 coupled to valve 54, pneumatic line 114 coupled to valve 50, and pneumatic line 116 coupled to valve 56.

The first plurality of valves 46, 48 and 50 and the second plurality of valves 52, 54 and 56 are preferably pneumatically-operated, proportional valves that allow for "soft" openings and closings. When used as described further below, this type of valve assists system 10 in providing a bumpless flow of the chemical or fluid through pipeline network 20. Incorporating soft opening and closing valves may greatly reduce surges within system 10 because rapidly closing valves can generate pressure surges ten times normal operating pressure in a liquid-filled system (no air bubbles or surface tanks). Additionally, using a pneumatic valve, allows the valves to be designed for an appropriate fail safe position should the pneumatic source become depleted during an emergency or otherwise.

A plurality of lines couple the third plurality of valves 70, 72, and 74 and the fourth plurality of valves 86, 88, and 90 with control module 100. The plurality of lines may be pneumatic or electrical, depending on the selection of valves for the third plurality of valves 70, 72, and 74 and fourth plurality of valves 86, 88, 90. Because activation of the third 70, 72 and 74 and fourth 86, 88 and 90 plurality of valves in a quick opening and closing manner is not likely to cause a bump in the flow in pipeline network 20, solenoid-activated valves may be used for the third 70, 72 and 74 and fourth 86, 88 and 90 plurality of valves. The plurality of lines connecting the third plurality of valves 70, 72 and 74 and the fourth plurality of valves 86, 88 and 90 to control module 100 may include line 120 coupled to valve 70, line 122 coupled to valve 86, line 124 coupled to valve 72, line 126 coupled to valve 88, line 128 coupled to valve 74, and line 130 coupled to valve 90.

A filtering system 134 may be installed or disposed in pipeline network 20 between feed portion 24 and supply lines 12 and 14. Filtering system 134 may include a first filter 136 and a second filter 138. Filtering system 134, like the fluid-carrying pipes of pipeline network 20, may be formed of any suitable material known in the art, such as a TEFLON® material. In its normal operating mode, system 10 provides a continuous and bumpless flow; however, it may be desirable to periodically close valves 16 and 18 and purposefully cause bumps or high pressure surges to remove particles from system 10. After intentionally causing a bump or pressure surge, the filter system 134 would be removed and replaced with new filters.

In operation, system 10 may be operated to provide a continuous recirculation of the fluid in a bumpless manner. Referring now to FIGS. 2–7, one example of how the fluid in system 10 may be moved between tanks 28, 30, and 32 to provide the continuous, bumpless flow is described. The description is made with reference to simplified system 210, which is analogous to system 10 of FIG. 1.

For the example, first tank 228 and third tank 232 are filled with fluid or chemical 233 to be used through chemical supply line 212. A control module, such as control module 100, senses that first tank 228 and third tank 232 are full either by weight sensors and entry of the density of fluid 233 into the control module or by direct measuring sensors within tanks 228, 230, and 232. The control module is then in a position to begin, and the operator initiates the circulation of fluid 233 in system 210. It is, of course, to be understood that various features can be added to the software of the computer that is included with the control module; for example, a feature may include not allowing system 210 to begin if conditions are not correct, or to shut down if at some point, the fluid level gets too low or other complications arise such as the tank becoming too full.

Figure 2:
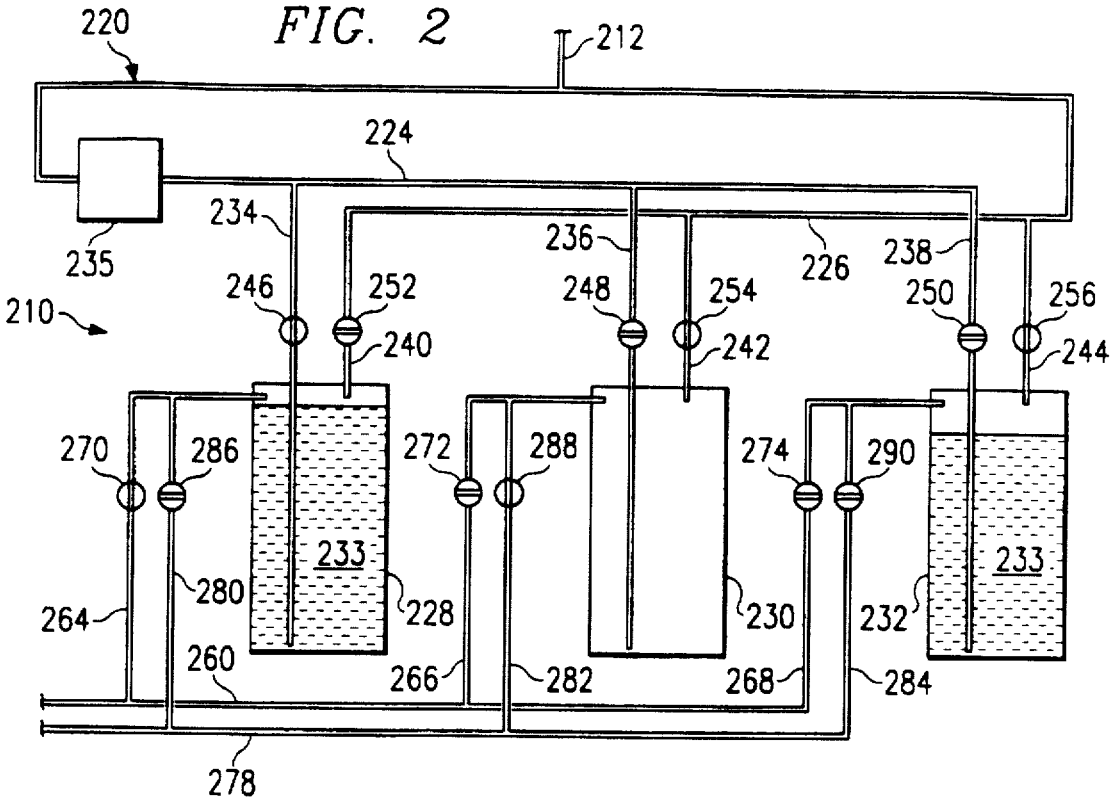
FIGS. 2–7 are a schematic representations of an aspect of the present invention showing the sequence of one technique for transferring the chemical between tanks in a continuous, bumpless manner.

During the loading and pre-initiation of system 210, all of the valves in the system are closed, i.e., valves 246, 252, 248, 254, 250, 256, 270, 286, 272, 288, 274, and 290. Referring now to FIG. 2, valve 270 is opened, which charges tank 228 with pressure from pressure line 260 and then valve 246 is opened. At approximately the same time, valve 254 is opened and valve 288 is opened, which opens tank 230 to ambient or atmospheric pressure (other embodiments may involve applying a vacuum on pipe 282). As a result of this valve arrangement, flow begins from first tank 228 into pipe network 220 through feed portion 224 and flows through filtering system 235 and around to return portion 226, where it enters second tank 230 through pipe 242. This flow may continue until the fluid level in tank 230 becomes too high or the fluid level in tank 228 becomes too low.

Figure 3:
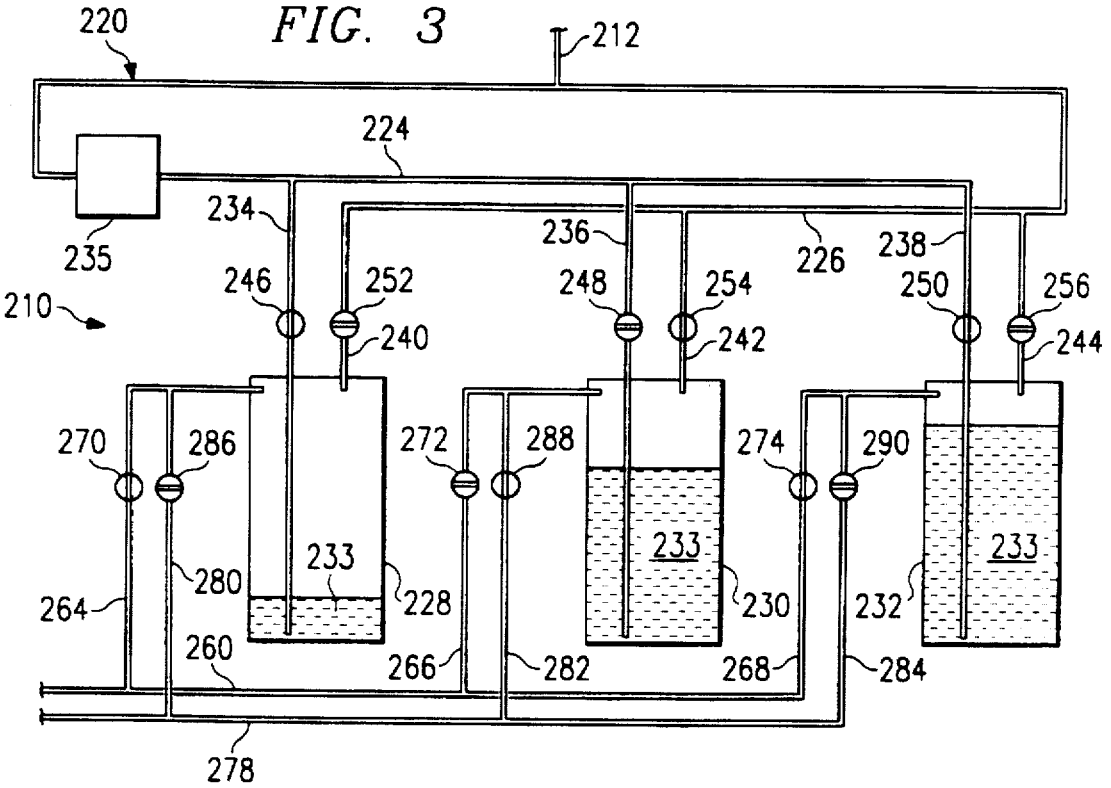

In the example presented, flow continues until the fluid level in first tank 228 becomes too low (e.g. within 20% of being empty) as shown in FIG. 3. The level at which the tank is considered low may be programmed as desired to prevent blowing a tank dry and if desired providing a safety margin as well. Once the control module has sensed that tank 228 is low, it causes valve 274 to open, which charges third tank 232. Valve 250 is then opened which causes fluid 233 to begin flowing from tank 232 into feeder portion 224 of pipe network 220. At this instance, fluid is flowing from both tanks 228 and 232 into tank 230. The pressure in tank 232 should be equalized with the pressure of tank 228 before opening valve 250. A smooth transition between tanks is made to prevent "bumps" or pressure surges in the flow. Once a smooth transition has been made between tank 228 and 232 by gradually opening valve 250 while gradually closing valve 246, the flow will be completely from tank 232 to second tank 230. This configuration will be maintained until the fluid level in third tank 232 becomes too low or the fluid level in second tank 230 becomes too high.

Figure 4:
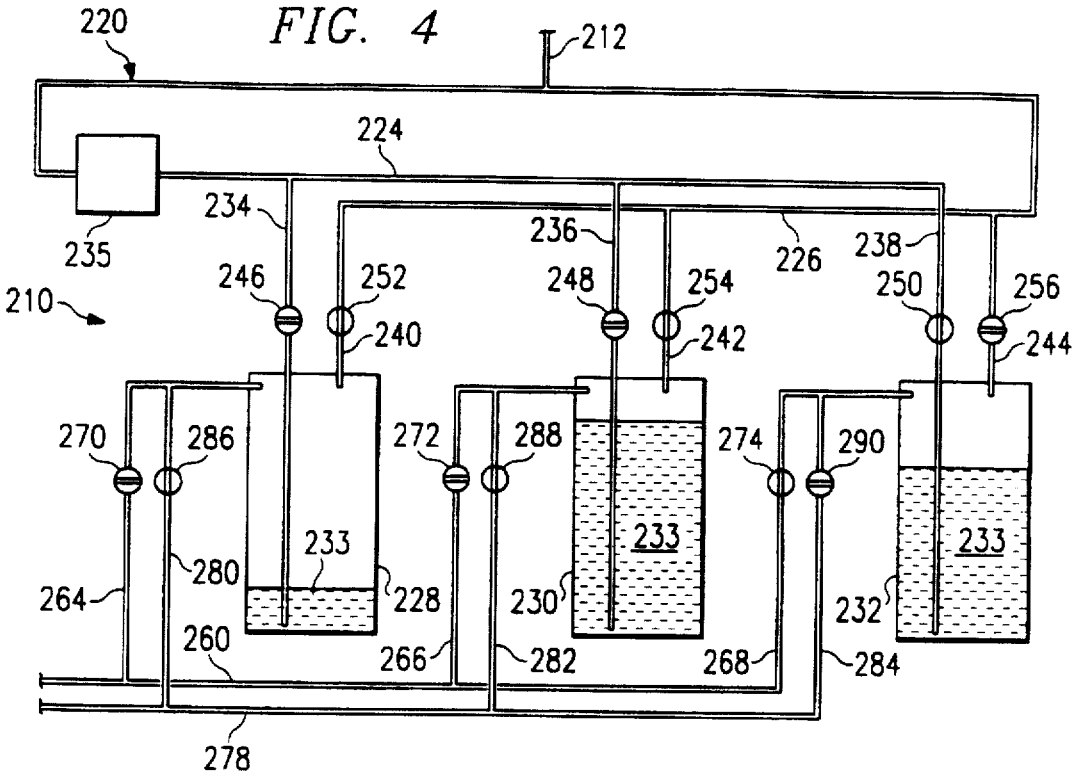

In the example, the next occurrence is that the fluid level in second tank 230 reaches a high level that triggers the control module to begin switching the fluid flow to an available tank as shown in FIG. 4. In this case, valve 252 is opened after valve 286 is opened and valve 270 is closed. The result is that fluid 233 may begin flowing into first tank 228, and for a period of time, fluid 233 is flowing into both first tank 228 and second tank 230. Valve 254 is slowly closed while valve 252 is slowly opened to provide a smooth transition to where valve 254 is completely closed and valve 252 is completely opened. The result of this configuration is that eventually fluid 233 flows exclusively from tank 232 to tank 228. Again, this flow configuration will continue until the fluid level in the feeding tank, tank 232, becomes too low, or fluid 233 in the receiving tank, tank 228, becomes too high.

Figure 5:
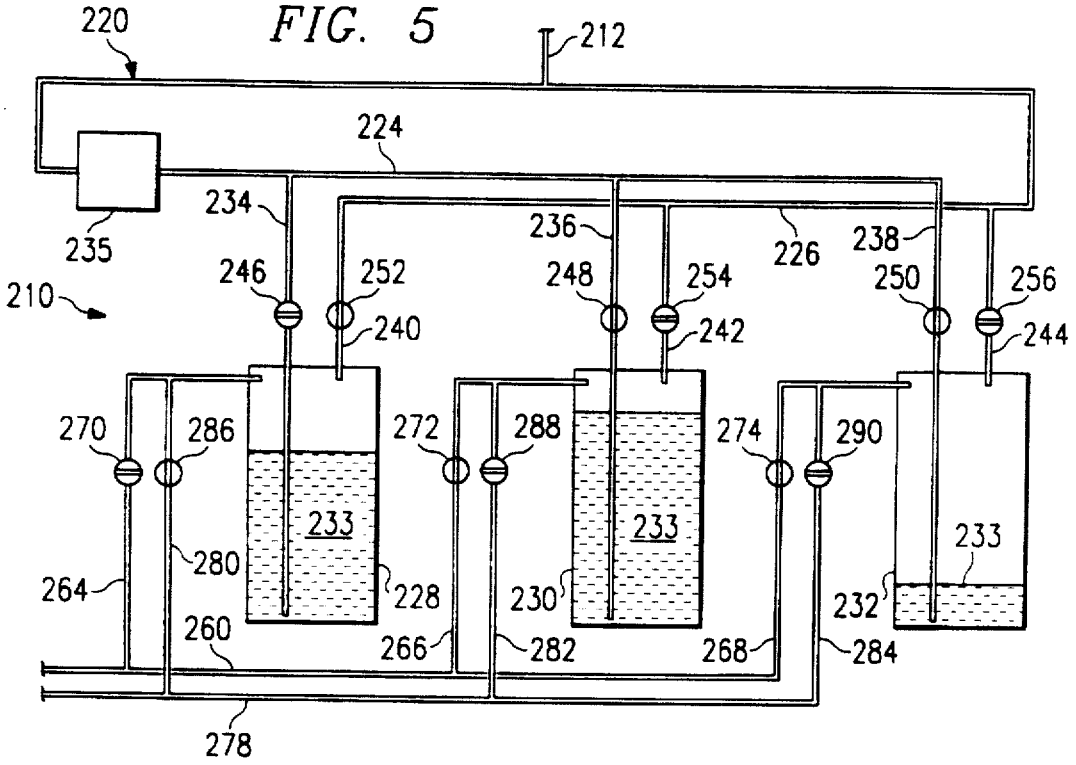

Referring now to FIG. 5, the next occurrence in the example is that third tank 232 reaches the low level, and the control module will then bring on line another source of fluid 233. Thus, valve 248 is caused to open after valve 272 is opened, which pressurizes tank 230 to approximately the same pressure as tank 232. Valve 288 remains closed. Thus, second tank 230 and third tank 232 both feed fluid 233 into pipe network 220 for a period of time. As valve 248 is opened, valve 250 is proportionately closed; the result is that there is a bumpless transition of the fluid flow into pipe network 220. Thereafter, fluid 233 is flowing from second tank 230 into first tank 228, and this will continue until the fluid level in the feeding tank, tank 230, becomes too low, or the fluid level in the receiving tank, tank 228, becomes too high. It should be noted that at this point in the operative sequence of the example, third tank 232 is not being used at all, and could be removed to provide additional chemical 233 to system 210, as may be necessary according to the extent to which the chemical is being removed through chemical supply line 212 for application by an end user.

Figure 6:
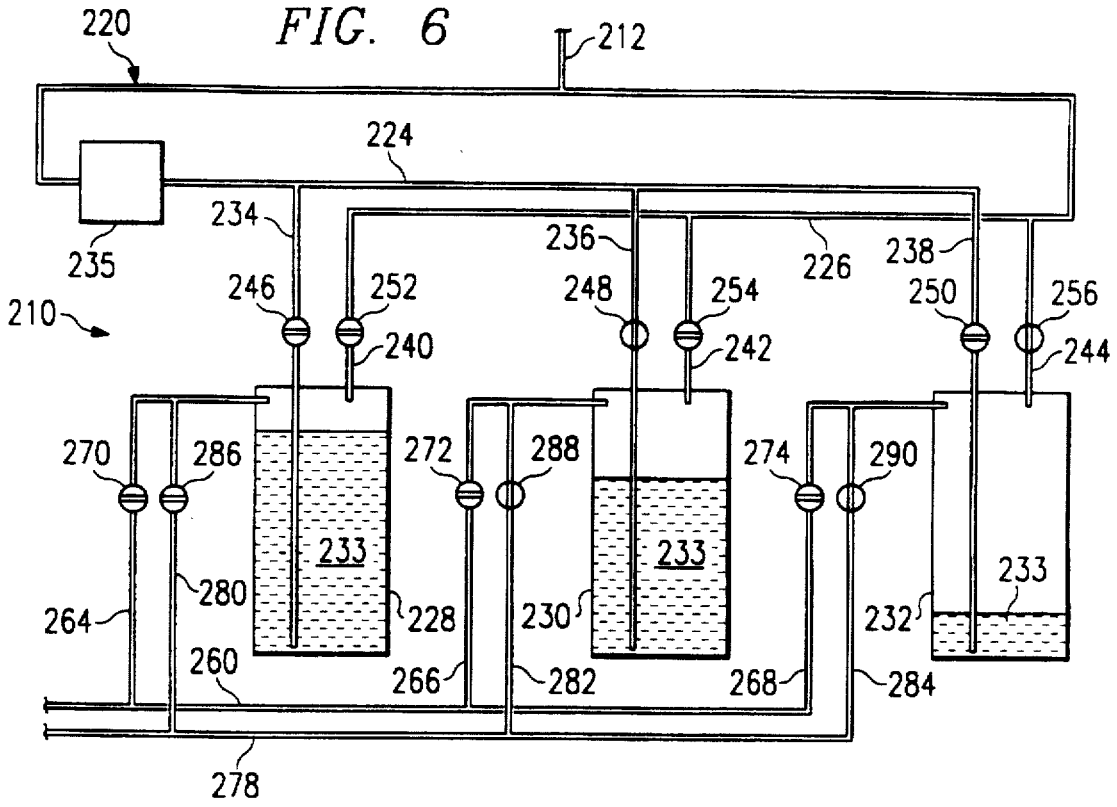

Referring now to FIG. 6, the next occurrence is that the fluid level in first tank 228 reaches a high level, and the control module arranges the valves to bring on line a new receiving source. Thus, valve 256 of third tank 232 is slowly opened as valve 252 of first tank 228 is slowly closed. Thus, a smooth or bumpless transition is made from first tank 228 as the receiving tank to third tank 232 as the receiving tank. Thereafter, fluid flow is exclusively from second tank 230 to third tank 232. This flow configuration is maintained until the fluid level in the feeding tank, tank 230, becomes too low, or the fluid level in the receiving tank, tank 232, becomes too high.

Figure 7:
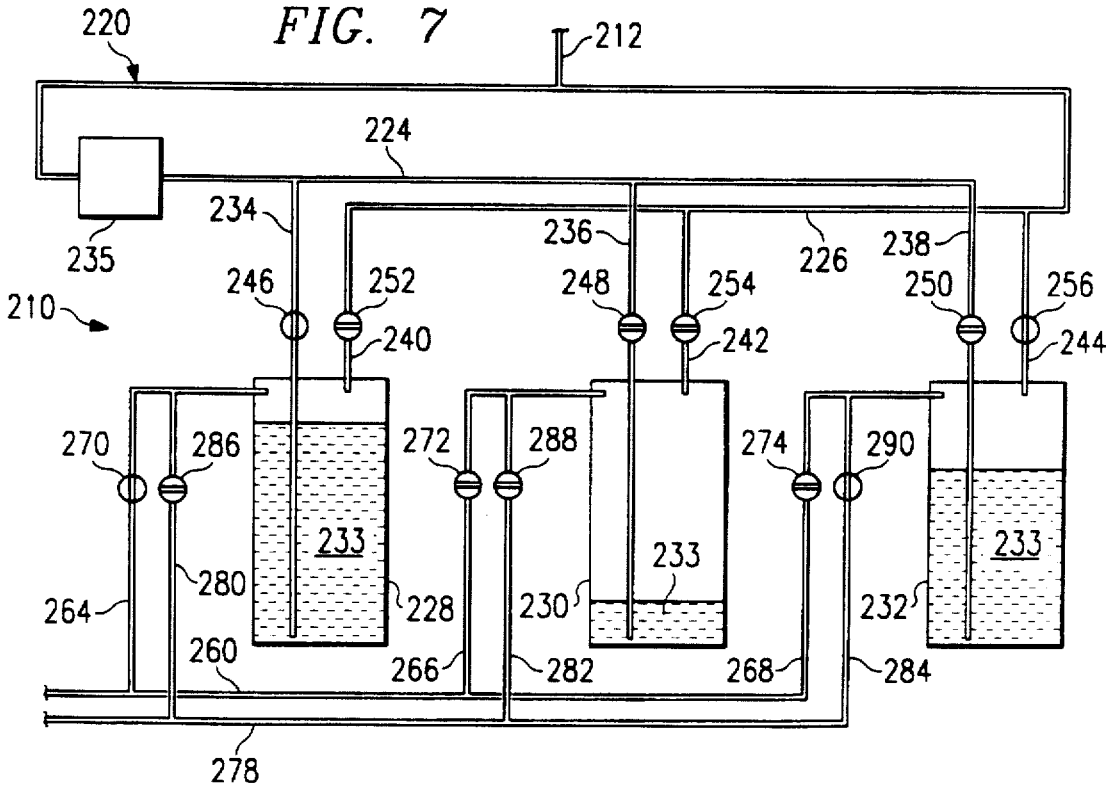

Referring now to FIG. 7, second tank 230 has reached the low point as determined by the control module, and the control module then rearranges the configuration to bring on line a new source. Valve 270 is opened to pressurize tank 228 and then valve 246 of first tank 228 is proportionately opened as valve 248 of second tank 230 is slowly closed. Thus, a smooth and bumpless transition is made from second tank 230 as the source of fluid 233 to first tank 228 as the source of fluid or chemical 233 for pipe network 220. This configuration is again continued until the feeding tank or source, tank 228, reaches a low point, or the fluid level in the receiving, tank 232, reaches a high level.

In the example, the next occurrence would be that tank 232 would reach a high level, at which time the control module will rearrange system 210 to provide a new receiving tank. Thus, valve 254 would be slowly opened as valve 256 is closed. Thus, fluid flow is again from first tank 228 into second tank 230 with third tank 232 having a fluid level ready to provide additional fluid as was the case when this example began. See FIG. 2.

The control module monitors the fluid levels throughout the system at all times and will set off an alarm when overall fluid 233 amount in the system gets too low. This process allows fluid 233 within system 210 to continuously flow between tanks which allows all the fluid to continually filter without any portion of it becoming stagnant for more than a short period of time (a period of time which is not dependent upon use through chemical supply lines 12, 14, 212). Additionally, this configuration allows for a completely bumpless system largely due to the smooth transition between "soft" pneumatic valves and because an inert gas pressure source is used to energize the system instead of a pump.

Although the present invention and its advantages have been described in detail, it should be understood that various changes, substitutions and alterations can be made therein without departing from the spirit and scope of the invention as defined by the appended claims.

What is claimed is:

1. A system for delivering a fluid comprising:

a first tank for holding a portion of the fluid;

a second tank for holding another portion of the fluid;

at least one additional tank for holding at least a portion of the fluid;

a pipeline network fluidly coupled to the first tank, the second tank, and said at least one additional tank, and having a feeding portion and a receiving portion;

at least one fluid supply line fluidly coupled to the pipeline network for supplying the fluid upon demand to an end user;

a first plurality of valves, the first plurality of valves being coupled to the first tank, the second tank, and said one additional tank to selectively control the flow of the fluid from the tanks into the feeding portion of the pipeline network;

a second plurality of valves coupled to the first tank, the second tank, and said one additional tank to selectively control the flow of the fluid from the receiving portion of the pipeline network into the first tank, the second tank, and additional said at least one tank;

a control module coupled to the first and second plurality of valves for selectively controlling the opening and closing of each valve;

a plurality of sensors coupled to the first tank, the second tank, and additional tank and coupled to the control module for allowing the control module to sense the amount of fluid in each tank;

a pressure source coupled to the first tank, second tank, and said at least one additional tank;

a third plurality of valves coupled to the first tank, the second tank, and said at least one additional third tank, and coupled to the pressure source, each valve of the third plurality of valves also being coupled to the control module for selectively allowing the tank coupled to the valve to be exposed to the pressure source;

a fourth plurality of valves coupled to the first tank, the second tank, and additional tank, each of the valves of the fourth plurality of valves being coupled to the control module for selectively allowing the tank coupled thereto to be exposed to a pressure less than the pressure source; and the control module operable being to control the first, second, third, and fourth plurality of valves in a predetermined sequence to move the fluid in a continuous, bumpless manner through the system.

2. The system of claim 1, wherein each valve of the first and second plurality of valves comprises a proportional valve capable of opening and closing slowly.

3. The system of claim 1, wherein each valve of the first and second plurality of valves comprises a slow opening and closing pneumatic valve.

4. The system of claim 1 further comprising a filter system coupled to the pipeline network.

5. The system of claim 1 further comprising a filter system coupled to the pipeline network between the fluid supply line and the feeding portion.

6. The system of claim 1 wherein the control module comprises a processor and a pneumatic controller coupled to the processor and the first and second plurality of valves.

7. The system of claim 1 wherein the control module will stop the system if the fluid level becomes lower than a predetermined amount.

8. The system of claim 1 wherein one of the tanks is a movable tank that may be removed and replaced to supply or remove additional fluid into the system.

9. A method supplying a fluid having a selected chemical concentration comprising the steps of:

providing a first tank for holding at least a portion of the fluid;

providing a second tank for holding at least a portion of the fluid;

providing a third tank for holding at least a portion of the fluid;

providing a pipeline network fluidly coupled to the first tank, the second tank, and the third tank, and having a feeding portion and a return portion;

coupling a chemical supply line to the pipeline network for supplying the chemical upon demand to an end user;

coupling a first plurality of valves to the first, second, and third tanks to selectively control the flow of the chemical from the tanks into the feeding portion of the pipeline network;

coupling a second plurality of valves to the first, second, and third tanks to selectively control the flow of the chemical from the return portion of the pipeline network into the first, second, and third tanks;

coupling a control module to the first and second plurality of valves for selectively controlling the opening and closing of each valve;

coupling a plurality of sensors to the first, second, and third tanks and coupled to the control module for allowing the control module to sense the amount of chemical in each tank;

coupling a pressure source to the first tank, second tank, and third tank;

coupling a third plurality of valves to the first, second, and third tanks, and coupled to the pressure source, each valve of the third plurality of valves also coupled to the control module for selectively allowing the tank coupled to the valve to be exposed to the pressure source;

coupling a fourth plurality of valves to the first, second, and third tanks, each of the valves of the fourth plurality of valves coupled to the control module for selectively allowing the tank coupled thereto to be exposed to a pressure less than the pressure source; and circulating the chemical to supply the chemical to the chemical supply line at all times by opening and closing the first, second, third, and fourth plurality of valves to provide a continuous, bumpless flow of chemical through the pipeline network.

10. The method of claim 9 further comprising the step of coupling a filtering system in the pipeline network.

11. The method of claim 9 wherein the step of coupling a first plurality of valves comprises coupling proportional valves capable of opening and closing slowly to the first, second, and third tanks.

12. The method of claim 9 wherein the step of coupling a second plurality of valves comprises coupling proportional valves capable of opening and closing slowly to the first, second, and third tanks.

13. The method of claim 9 wherein the step of providing a third tank comprises the step of providing a removable tank.

14. The method of claim 9 wherein the step of coupling a control module comprises the step of coupling a processor and a pneumatic controller.

15. A system for delivering a very pure fluid with a selected fluid mixture, the system comprising:

a first tank for holding at least a portion of the fluid;

a second tank for holding at least a portion of the fluid;

a third tank for holding at least a portion of the fluid;

a pipeline network having a feeding portion and return portion;

a fluid supply line coupled to the pipeline network for supplying the fluid upon demand by an end user;

a filtering system coupled to the pipeline network and disposed between the feeding portion of the pipeline network and the fluid supply line;

a first plurality of valves coupled to the first, second, and third tanks and coupled to the feeding portion of the pipeline network for selectively allowing fluid to flow from the first, second, and third tanks into the pipeline network;

a second plurality of valves coupled to the first, second, and third tanks and coupled to the return portion of the pipeline network for selectively allowing the flow of fluid from the return portion into the first, second, and third tank;

a first pressure source;

a second pressure source having a lower pressure than the first pressure source such that the pressure differential will move the fluid through the pipeline network;

a third plurality of valves coupled to the first, second, and third tanks and coupled to the first pressure source for selectively exposing the interior of the first, second, and third tanks to the first pressure source;

a fourth plurality of valves coupled to the first, second, and third tanks and coupled to the second pressure for selectively exposing the interior of the first, second, and third tanks to the second pressure source;

a plurality of sensors for measuring the quantity of the fluid in the system and in each tank at any given instance; and a control module coupled to the first plurality of valves, the second plurality of valves, the third plurality of valves, the fourth plurality of valves, and the plurality of sensors and operable to open and close the first, second, third, and fourth pluralities of valves in a predetermined sequence to continuously and bumplessly move the fluid through the pipeline network.

16. The system of claim 15, wherein each valve of the first and second plurality of valves comprises a proportional valve capable of opening and closing slowly.

17. The system of claim 15, wherein each valve of the first and second plurality of valves comprises a slow opening and closing pneumatic valve.

18. The system of claim 15 wherein the control module comprises a processor and a pneumatic controller.

19. The system of claim 15 wherein the control module will stop the system if the fluid level becomes lower than a predetermined amount.

20. The system of claim 15 wherein the third tank is a movable tank that may be removed and replaced to supply additional fluid into the system.

* * * * *